United States Patent [19]

Freudentahl et al.

[11] Patent Number: 5,076,491

[45] Date of Patent: Dec. 31, 1991

[54] BOX OF CORRUGATED FIBREBOARD AND PACKAGING METHOD

[75] Inventors: Håkan Freudentahl, Timrå; Lars Brus, Järfälla, both of Sweden

[73] Assignee: Wifstavarfs Aktiebolag, Sweden

[21] Appl. No.: 456,526

[22] Filed: Dec. 26, 1989

[30] Foreign Application Priority Data

Aug. 7, 1989 [SE] Sweden ..... 8902684

[51] Int. Cl.[5] ..... B65D 5/32; B65D 5/46

[52] U.S. Cl. ..... 229/117.16; 229/23 R; 229/125.32

[58] Field of Search ..... 229/23 R, 23 BT, 117.13, 229/117.16, 125.32

[56] References Cited

U.S. PATENT DOCUMENTS

| | | | |
|---|---|---|---|
| 626,681 | 6/1899 | Etnier . | |
| 2,880,866 | 8/1959 | Van Dyck | 206/83.5 |
| 3,055,573 | 9/1962 | Carter | 229/117.16 |
| 3,910,483 | 10/1975 | Ritter | 229/23 BT |
| 4,101,052 | 7/1978 | Dove | 229/23 R |
| 4,747,486 | 5/1988 | Benno | 229/117.16 |
| 4,754,879 | 7/1988 | Benno | 229/117.16 |
| 4,801,077 | 1/1989 | Sweatt, III et al. | 229/125.32 |
| 4,802,586 | 2/1989 | George | 206/556 |
| 4,848,651 | 7/1989 | Hartness | 229/23 BT |
| 4,852,796 | 8/1989 | Katzman | 229/23 BT |
| 4,869,424 | 9/1989 | Wood | 229/23 BT |

FOREIGN PATENT DOCUMENTS

| | | |
|---|---|---|
| 0112411 | 7/1984 | European Pat. Off. . |
| 0177304 | 4/1986 | European Pat. Off. . |
| 3123192A1 | 8/1982 | Fed. Rep. of Germany . |
| 8422076 | 1/1987 | Fed. Rep. of Germany . |
| 2478581 | 9/1981 | France . |
| 7316763-7 | 9/1975 | Sweden . |

*Primary Examiner*—Gary E. Elkins

*Attorney, Agent, or Firm*—Burns, Doane, Swecker & Mathis

[57] ABSTRACT

Box of corrugated fibreboard intended for packaging objects in the form of cut fine paper, comprising a lower portion (1) and an upper portion (10) with walls (3,4 and, respectively, 12,13,14) extending all about. The upper portion (b 10) is formed to contain the objects, and the walls (3,4) of the lower portion (1) extend a short distance outside the walls (12,13,14) of the upper portion. Opposed end walls (4) on the lower portion (1) are provided at their upper edges with handle lugs (6), which are foldable outward from the end walls (4).

According to the invention the objects first are placed in the upper portion (10). Its walls (12,13,14) are folded upward and enclose the objects. Thereafter the lower portion (1) is placed upon. Finally the box is turned to right side up.

6 Claims, 2 Drawing Sheets

BOX OF CORRUGATED FIBREBOARD AND PACKAGING METHOD

This invention relates to a box of corrugated fibreboard, which is intended for packing objects in the form of cut fine paper, and to a method of packing objects in the box.

Fine paper, usually cut to A4-size is used to a great extent in offices as copying paper as well as writing and printing paper. During its transport and storage, the paper mostly is packed in a box of corrugated fibreboard. In the box, the paper lies in wrapped packs with 500 sheets (1 ream) in each pack. Conventional boxes comprise a lower portion, in which the ream-pack is placed, and a cover. At the packaging, tapes are wound about the box for holding it together. These tapes also can serve as carrying handle at the handling of the box.

It was found, however, that the handling of these boxes in offices gives rise to problems. The boxes are cumbersome to carry, difficult to open, and it is difficult to take the ream-packs out even after the box has been opened.

The present invention offers a solution for the aforesaid problems. According to the invention, the upper portion of the box is formed so as to contain the objects, while the lower portion is provided with carrying handle formed integral with the lower portion. The box thereby is easy to carry. It is opened by lifting off the upper portion. The contents remain in the lower portion where they are easily accessible, because the walls of the lower portion are low.

The characterizing features of the invention are apparent from the attached claims.

The invention is described in greater detail in the following, with reference to the accompanying drawings showing an embodiment of the invention.

Figure 1:
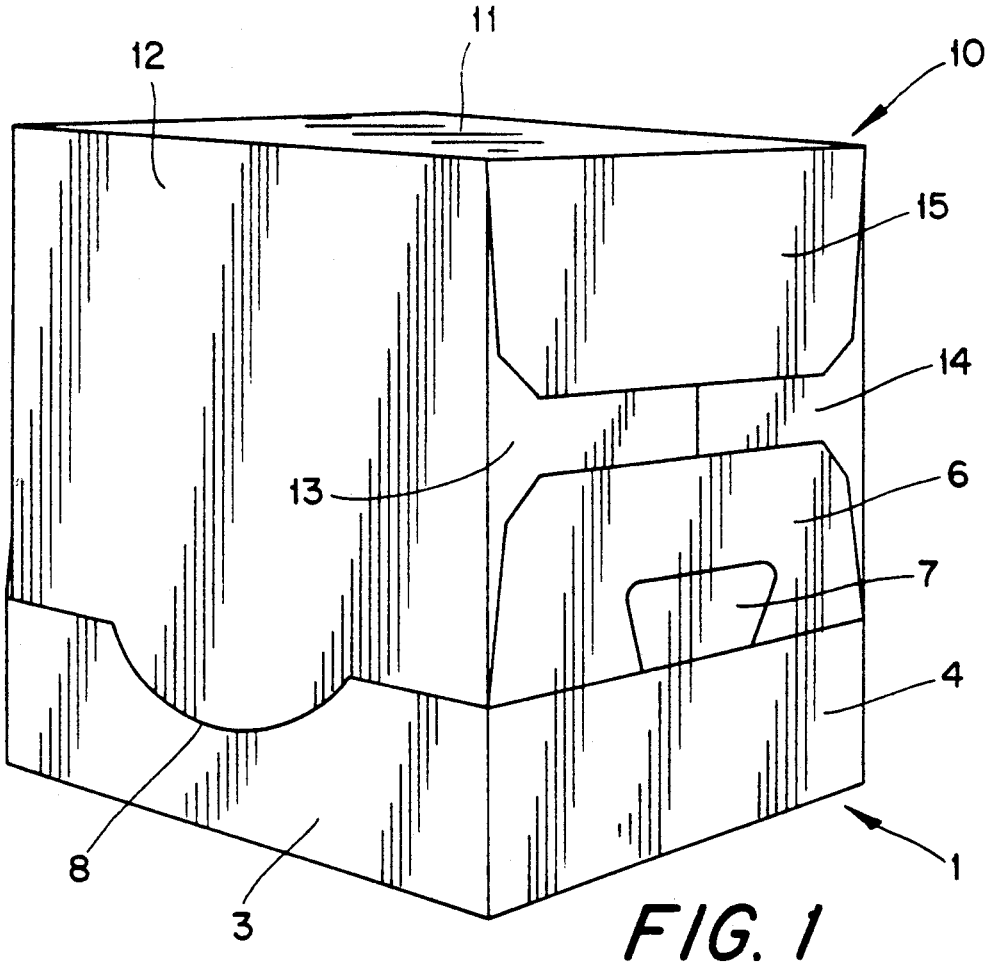
FIG. 1 shows a box according to the invention.
Figure 2:
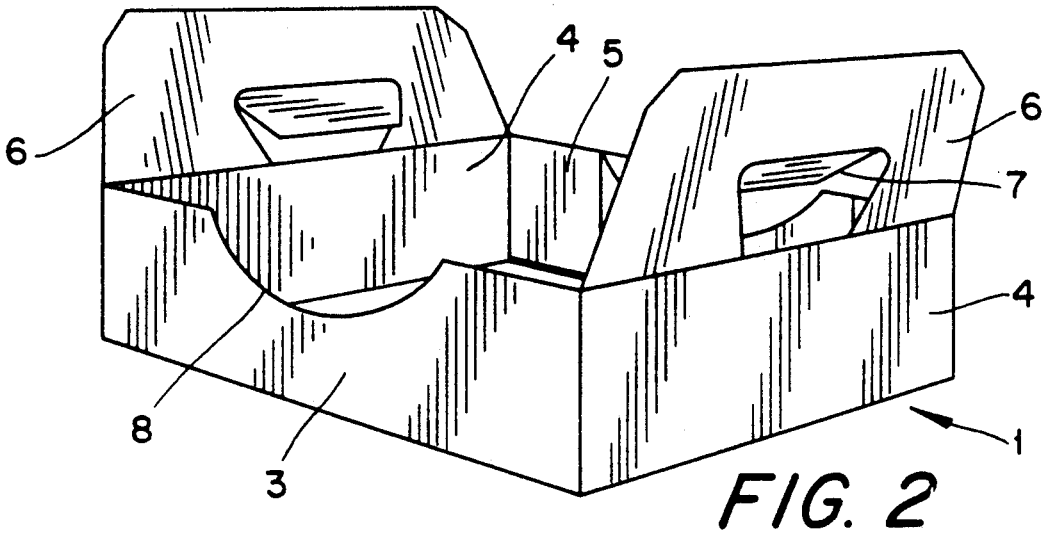
FIG. 2 shows the lower portion of said box.
Figure 3:
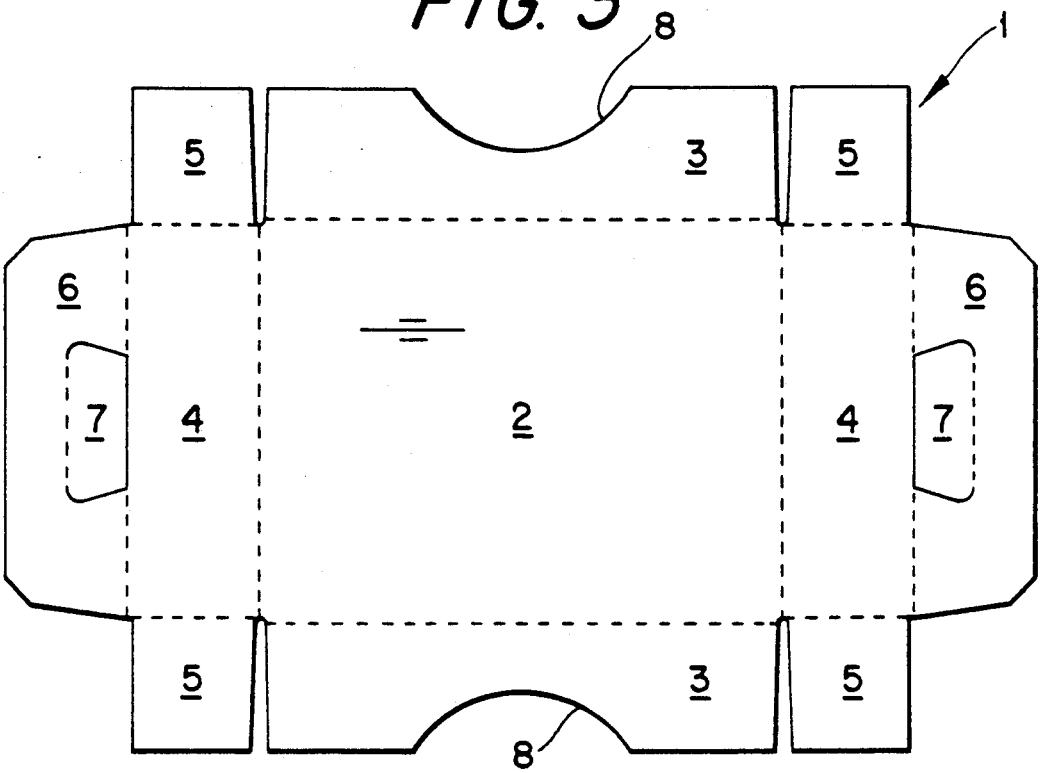
FIG. 3 shows the blank for the lower portion.
Figure 4:
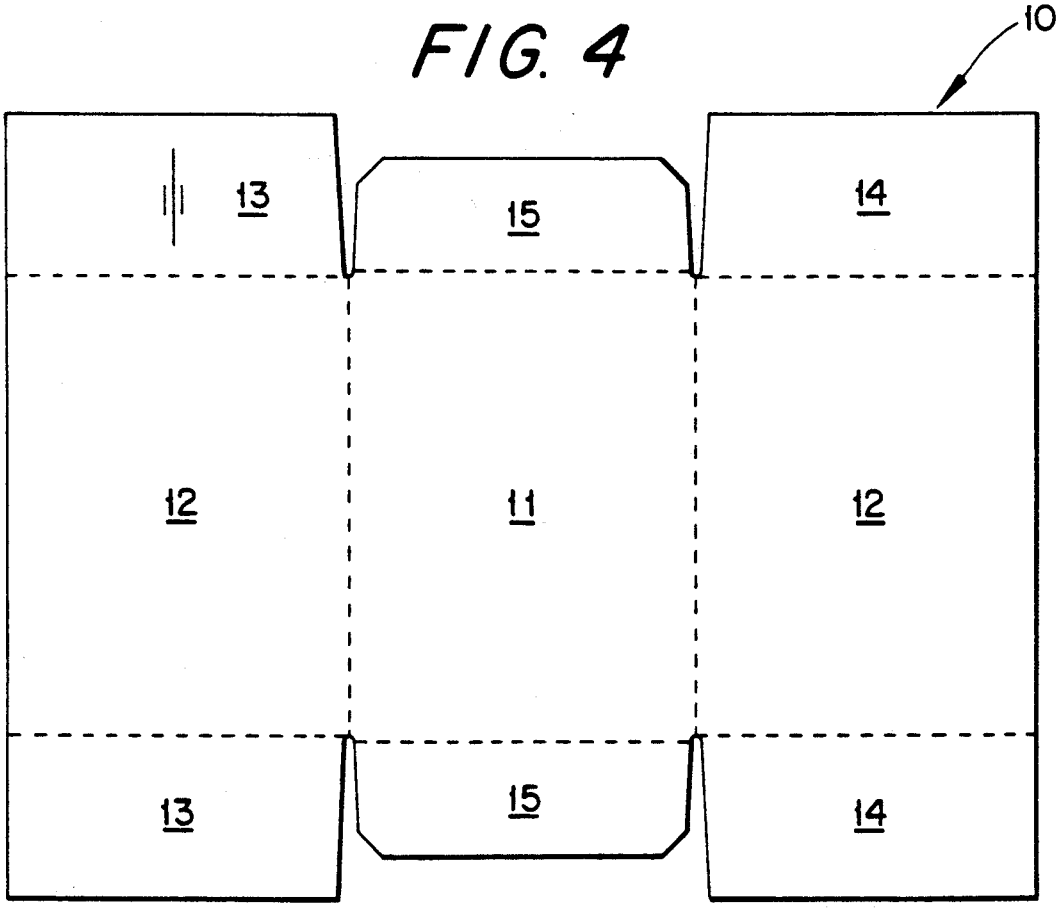
FIG. 4 shows the blank for the upper portion.

The lower portion 1 of the box shown consists of a bottom field 2, sidewalls 3, end walls 4, corner lugs 5 and handle lugs 6 on the end walls 4. The handle lugs 6 are provided with punched-out handle holes 7. The sidewalls 3 are provided with a cut-back.

At the embodiment shown, the corner lugs extend from the end walls 4 and are glued to the inside of the sidewalls 3. Alternatively, the corner lugs can extend from the sidewalls 3 and be glued to the inner or outer side of the end walls 4.

In the handle hole 7, the punched-out piece should remain suspended on the upper edge of the hole in order to render a more comfortable grip.

The upper portion 10 consists of a top field 11, sidewalls 12, end walls 13, 14 and gable lugs 15. The gables of the upper portion, thus, are defined by the end walls 13, 14, each of which extends from the sidewalls 12 across half the gable and is secured by means of the gable lug 15.

The upper portion 10 is dimensioned after the paper sheets to be packed, and the lower portion 1 is formed so that its walls 3, 4 extend a short distance upward outside the walls 13, 14, 15 of the upper portion, preferably less than one third of the box height.

The height of the box is determined by the height of the upper portion 10, because this is intended to enclose the objects. It may, however, be suitable to let the stack of paper sheets be slightly higher than the height of the walls 13, 14, 15, because this implies that the paper sheets take up the load of stacking whereby breaking of the walls is prevented.

The box during its transport and storage has the appearance shown in FIG. 1. When individual boxes are handled, for example in an office, the handle lugs 6 are folded out whereby the box is rendered easy to carry.

The box is opened by lifting off the upper portion 10. The packs of paper sheets due to their weight remain in the lower portion 1 where they are easily accessible owing to the low walls 3, 4. The cut-backs 8 are intended to additionally facilitate the removal of the lowermost pack from the box. As the carrying handles are located on the lower portion, the box can be handled easily even in open state.

The paper sheets are packed mechanically in the way as follows. After the paper sheets have been bundled, a certain number of packs, preferably five packs, are placed on the packaging blank for the upper portion 10. The walls 12, 13, 14 are folded upward and are secured by means of the gable lug 15, which is glued to the end walls 13, 14. Thereafter the lower portion 1 is placed thereupon, and the walls 3, 4 are folded downward outside the upper portion. The walls are secured by means of the corner lugs 5. The handle lugs 6 then also will abut the upper poriton 10.

The completed boxes thereafter are to be stacked to a unit load to be transported to the consumers. The completely packed boxes, however, must be turned, because the packaging took place upside-down. This can be carried out either after the unit load has been completely stacked, by turning the entire load, or by turning one and each of the completely packed boxes prior to the stacking. In order to hold together the finally formed unit load, preferably a shrink film is attached about the entire unit. The method implies at the same time, that no separate attaching of lower and upper portion is required.

The invention, of course, is not restricted to the embodiment shown, but can be varied within the scope of the invention idea.

We claim:

1. Box of corrugated fibreboard for packaging objects in the form of cut fine paper, comprising a lower portion and an upper portion, both of which are formed with walls extending from a circumference of said lower and upper portions, wherein the upper portion is formed to contain the objects, wherein the walls of the lower portion extend a short distance outside the walls of the upper portion, wherein opposed end walls on the lower portion include upper edges having handle lugs in which handle holes are punched out, which lugs are foldable outwardly from the end walls, wherein opposed sidewalls of the lower portion are formed with a cut-back, which extends downwardly from an upper edge in the sidewalls.

2. A corrugated fibreboard box for holding a plurality of prepackaged reams of cut fine paper comprising:

a lower portion having a bottom panel and lower portion circumferential walls, said lower portion circumferential walls extending from outer edges of said bottom panel;

an upper portion having a top panel and upper portion circumferential walls, said upper portion circumferential walls extending substantially at a 90 degree angle from outer edges of said top panel; and said upper portion circumferential walls extending a distance sufficient to enclose a plurality of prepackaged reams of cut fine paper disposed on said bottom panel;

said outer edges of said bottom panel being positioned a short distance outside the outer edges of said top panel such that said lower portion circumferential walls extend at a location outside said upper portion circumferential walls;

said upper portion being removable from said lower portion to expose said prepackaged reams of cut fine paper disposed on said bottom panel; and a handle lug disposed on each of two opposing walls of said lower portion circumferential walls, said handle lug projecting upwardly from each of said opposing walls, said handle lug for each of said two opposing walls being deflectable outwardly from a plane containing the wall corresponding to said handle lug.

3. A corrugated fibreboard box according to claim 2, wherein said lower portion circumferential walls have a height no larger than one third the height of said box.

4. A corrugated fibreboard box according to claim 2, wherein opposed sidewalls of said lower portion include a cut-back extending downwardly from an upper edge of the sidewalls.

5. A corrugated fibreboard box according to claim 2, wherein said lower portion includes corner lugs, said corner lugs extending from end walls of said lower portion and being glued to an inside surface of sidewalls of said lower portion.

6. A corrugated fibreboard box according to claim 2, wherein said lower portion includes corner lugs, said corner lugs extending from sidewalls of said lower portion and being glued to an outside surface of endwalls of said lower portion.

* * * * *